United States Patent [19]

Rest

[11] 4,432,388

[45] Feb. 21, 1984

[54] DEVICE FOR PREVENTING SEWAGE BACKUP IN DRAIN LINES

[76] Inventor: Jerome Rest, 8827 N. Ewing Ave., Skokie, Ill. 60203

[21] Appl. No.: 337,611

[22] Filed: Jan. 7, 1982

[51] Int. Cl.[3] ..... F16K 31/128

[52] U.S. Cl. ..... 137/403; 137/362; 137/487.5; 138/93

[58] Field of Search ..... 137/362, 236, 451, 403, 137/487.5; 138/93

[56] References Cited

U.S. PATENT DOCUMENTS

| | | | |
|---|---|---|---|
| 1,109,740 | 9/1914 | Dehn | 137/362 X |
| 2,514,040 | 7/1950 | Eksergian | 138/93 X |
| 2,549,204 | 4/1951 | Kaddatz | 137/362 X |
| 2,793,371 | 5/1957 | Vesconte | 137/362 X |
| 3,086,540 | 4/1963 | Anderson | 138/93 X |

*Primary Examiner*—Alan Cohan

[57] ABSTRACT

A device for automatically preventing the backup of sewage in a gravity discharge drain line consisting of an expansible bladder in conjunction with a reverse flow detector, means for inserting said device to a remote section in said drain line, a pressure source for expanding said bladder to a predetermined pressure to block reverse flow upon signal from said reverse flow detector, electrical and mechanical means for remote automatic operation of said device, said electrical and mechanical means containing elements for return of said device to normal standby position when the backup condition is rectified.

In addition, the device contains a self cleaning feature and means for simulating a backup condition for checking the integrity of the device.

9 Claims, 7 Drawing Figures

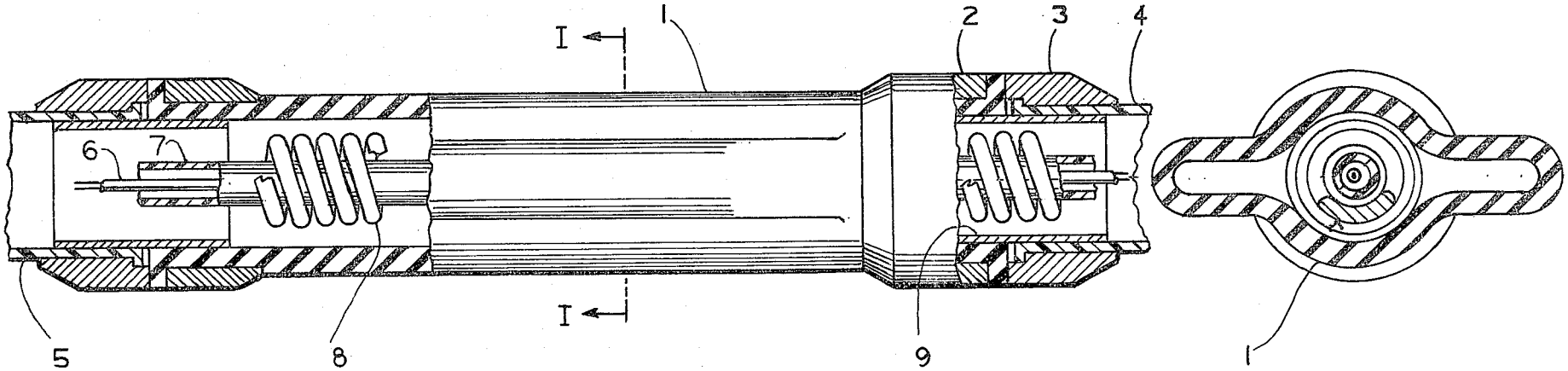
FIG. 1
FIG. 2
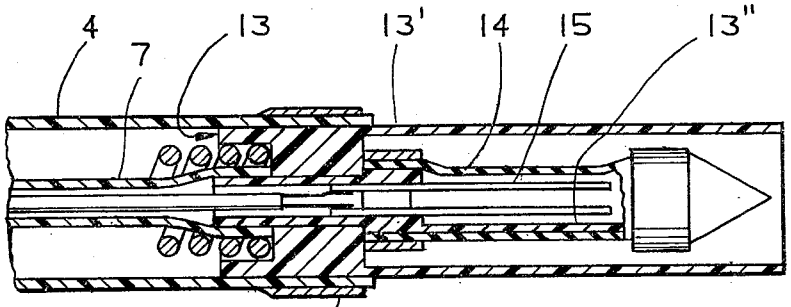
FIG. 4
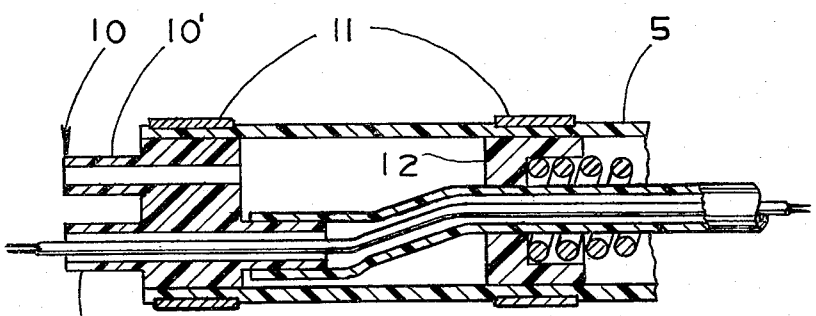
FIG. 3

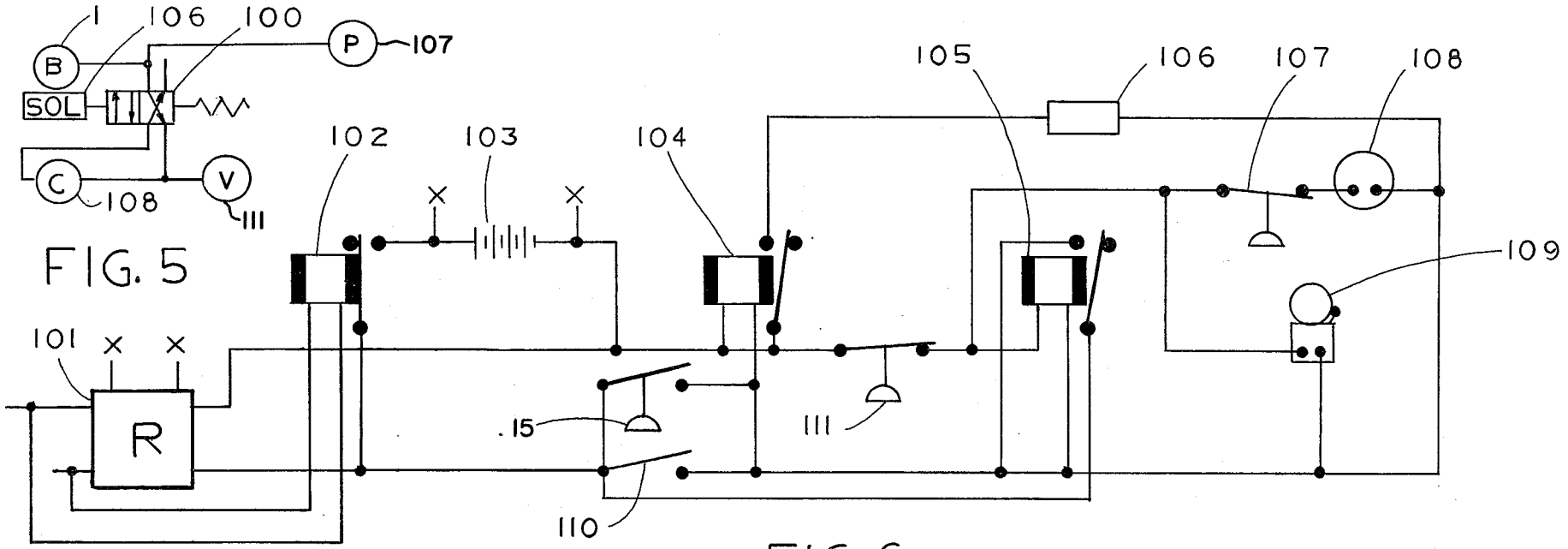
FIG. 5
FIG. 6
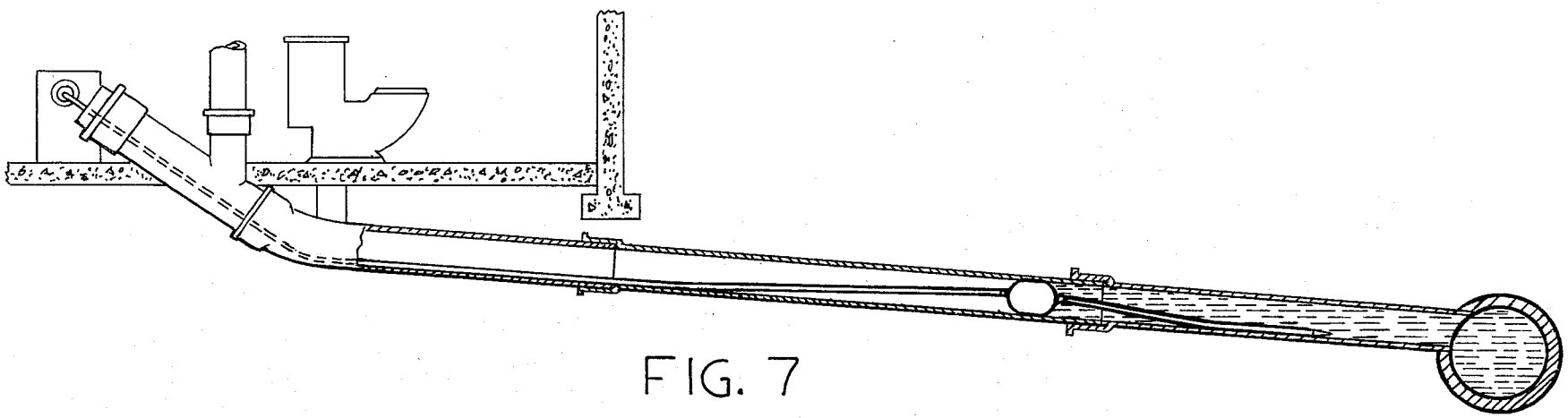
FIG. 7

DEVICE FOR PREVENTING SEWAGE BACKUP IN DRAIN LINES

BACKGROUND

My invention relates to a novel device for automatically preventing backup of sewage in drain lines, particularly in metropolitan residential areas, in the event the sewage disposal system reaches an overflow condition during a period of heavy rainfall.

Due to the burgeoning population growth, sewer systems built 20 to 30 years ago are becoming inadequate to dispose of the combined sewage and rainwater in periods of heavy rainfall. Overflow of the system occurs, resulting in backup of sewage in the drain lines of residences and buildings where none had occurred previously. Livable and storage areas below grade become flooded causing incalculable damage and anguish.

There are a number of devices on the market for preventing sewage backup. Two devices such as (1) an overhead drain line, or (2) a check valve located between the dwelling and the sewer are effective but very costly to install in established buildings. Other simple and inexpensive devices can be used such as check valves or standpipes in the floor drains but present an element of risk. Instances are known where water seepage occurred under the floor resulting in a pressure sufficient to break up the floor. All other known devices for preventing sewage backup are either variations or combinations of the above.

My invention overcomes the drawbacks of the above mentioned devices in that it is relatively inexpensive to manufacture and is easily installed. Since it is installed in the drain line at a remote distance from the building, it provides safety from water seepage under the floor. In addition, since reliability is of prime importance, means are incorporated in the device to simulate a backup condition for checking the integrity of the device.

SUMMARY

My invention consists essentially of a folded or pleated bladder used in conjunction with a reverse flow fluid pressure detector. These are inserted in the drain line at a remote and secure distance from the building with the detector downstream of the bladder. Insertion of the device is accomplished through a cleanout opening closest to the outgoing drain line. A special adapter cleanout flange seals the drain line after installation. When backup occurs, the detector energizes a pressure source and inflates the bladder to a predetermined pressure to block the line. When the backup condition is eliminated, means are provided to return the device automatically to normal standby position.

The proportions of the device have been designed to be compatible with the flow requirements of the drain line and all components are contoured and blended to offer minimal resistance to flow.

To yield a minimal cross-section to flow in normal standby position and yet provide sufficient material for the bladder, folds or pleats have been incorporated in the bladder. In addition, the detector has been designed to register pressure on a longitudinal surface parallel to flow, thus permitting reduction of the detector cross-section to minimal size.

In ascertaining the effect on the cross-sectional area of the drain line by the introduction of the device, a specific example will be used.

In many cities of the United States a four inch diameter drainpipe is used. The commercial tolerances on the inside diameter are plus or minus 0.09 of an inch. If the minus tolerance is used, the area of the cross-section will be reduced by 4.45% from the nominal value.

In normal standby position, the component having the largest cross-section, the bladder, will reduce the nominal value by 3%. It is thus seen that the device will have a negligible effect on the flow of fluid through the drain line.

Where the storm drains also enter the drain system, a second bladder operating in parallel with the first can be installed to block the storm drains, providing they enter the main drain line at one point. Where this is not the case, the storm drains must be disconnected for the device to be effective.

DESCRIPTION OF THE DRAWINGS

The invention will be more fully described with reference to the accompanying drawings in which:

FIG. 1 is a cut-away view of the bladder in normal standby position;

FIG. 2 is a section taken on the line 1—1 of FIG. 1;

FIG. 3 is a sectional view showing the external end connections;

FIG. 4 is a cross-sectional view showing details of the reverse flow fluid pressure detector;

FIG. 5 is a schematic showing the valve arrangement;

FIG. 6 is an electrical schematic illustrating the operation of the device; and

FIG. 7 shows a typical installation of the device in energized position.

In FIGS. 1 and 2 I have shown the folded bladder 1 which may be fabricated from a rubber or elastomeric material, connected at one end to an elastic tube 5 for inflation or deflation of the bladder, and the other end to a similar tube 4 for securing the bladder 1 to the detector 13. Inner reinforcing rings 9 in conjunction with banding straps 2 and 3 are used to obtain leakproof connections. To prevent snagging of any material in flow, banding straps 2 and 3 are contoured to provide a smooth transition surface from tubes 4 and 5 to the bladder 1.

Contained concentrically within the assembly of bladder 1 and tubes 4 and 5 is a spring wound steel coil 8 for imparting longitudinal stiffness to the device and a flexible service tube 7 connected to the detector 13. The steel coil is anchored at one end to the detector 13 and the opposite end to ring 12 by means of banding strap 11. The steel coil enables insertion of the device to a remote distance within the drain line.

As shown in FIG. 4 the detector 13 is comprised of a detector housing 13'', an expansible diaphragm 14 which encloses an opening in the detector housing 13'' containing a pair of electrical contacts 15 and a diaphragm shield 13'. The detector 13 is secured to the bladder 1 but is isolated from bladder pressure by means of the aforementioned tube 4 and banding clamp 16. The diaphragm shield 13' servces to isolate normal drainage flow from the diaphragm as it flows to the sewer.

When reverse flow occurs, fluid enters the detector 13 exerting a pressure on diaphragm 14. This pressure, by means of the diaphragm, is transmitted through the opening in detector housing 13'' to bear against one of the electrical contacts 15 contained therein. When a predetermined pressure is reached, the electrical contacts 15 close, energizing the device.

Since the force applied to one of the electrical contacts 15 is a function of the area of the opening in detector housing 13'', the sensitivity of the detector 13 to pressure is proportional to the length of the opening for a given width.

The detector service tube 7 serves five functions: (1) it isolates the detector 13 from the pressure or vacuum, whichever the case may be, surrounding the service tube 7; (2) it provides a passageway for exposing one side of the diaphragm 14 to the atmospheric pressure outside the drain line thus neutralizing the atmospheric pressure existing on the opposite side of the diaphragm 14 in the drain line; (3) it provides a means for externally applying a predetermined vacuum to the diaphragm 14 to simulate the pressure on the diaphragm when reverse flow occurs (this feature permits simple testing of the device to assure its integrity); (4) it provides an external means of dislodging any obstruction that may have been deposited on the diaphragm 14 during use by permitting the application of a pressure and vacuum cycle to expand and contract the diaphragm 14; (5) it serves as a conduit for the electric wires 6 to the external connections.

In FIG. 3, a closure component 10 seals tube 5 and permits application of pressure to the bladder 1 through a port 10'. The service tube 7 and electric wires 6 exit externally by means of port 10''.

Another feature of the device is the selection of a material in conjunction with wall thickness for the tubes 4 and 5 to permit expansion and contraction of the tubes under predetermined pressure values to facilitate the sloughing off of any deposits that may have accumulated on the tubes during use. The bladder 1, because of its expansible feature, is self-cleaning.

For automatic operation of the device, a control system has been devised, as shown schematically in FIG. 6, embodying electrical and mechanical components. For purposes of safety and simplicity, a low voltage 12 volts during current system has been selected which is obtained by means of a 110 VAC rectifier 101.

When the diaphragm 14 is deflected by fluid pressure due to reverse flow, the electrical contacts 12 close energizing relay 104. This activates solenoid 106 which positions a four way valve 100, (see FIG. 5) to direct compressed air to the bladder 1. Simultaneously, a holding relay 105 and air compressor 108 are energized. When the proper bladder pressure is reached for sealing the drain line, a pressure switch 107 opens and shuts off the air compressor 108.

When the reverse flow condition is eliminated, the electrical contacts 15 open and the solenoid 106 now positions the four way valve to exhaust the device through the intake side of the compressor 108. The pressure drop that results from the increase in volume causes the pressure switch 107 to close. Since the holding relay 105 maintains a closed circuit, the compressor 108, which now acts as a vacuum pump, resumes operation. When the predetermined vacuum for facilitating the reduction of the device to minimal size is reached, a vacuum switch 111 opens dropping out the holding relay 105 and returning the device to normal standby position.

Since the pressurized volume required to expand the bladder 1 is small, a relatively inexpensive 12 VDC compressor, similar to ones now used to inflate automobile tires and which operate from the battery, can be used.

In the event of a power failure, relay 102 becomes deenergized and a 12 VDC standby battery 103 is switched into the circuit. The battery 103 is kept fully charged at all times by means of a continuous maintainer charger incorporated in the rectifier 101.

When the device is in operation, an alarm 109 is sounded to alert the users of the drain system that a temporary blockage exists and that use of the drain system is limited to the capacity of the system to the point of blockage.

A manual override switch 110 permits operation of the device for the cleansing cycle mentioned above.

The invention is, of course, not limited to the specific embodiments described and illustrated but may be realized in various modifications, substitutions (e.g. a water pump for air compressor 108) adaptations or combinations without departing from the spirit and scope of the appended claims.

I claim:

1. A device for automatically preventing the backup of sewage in a gravity discharge drain line consisting of an expansible bladder in conjunction with a reverse flow detector, means for inserting said device to a remote section in said drain line, a pressure source for expanding said bladder to a predetermined pressure to block reverse flow upon signal from said reverse flow detector, electrical and mechanical means for remote automatic operation of said device, said electrical and mechanical means containing elements for return of said device to normal standby position when the backup condition is rectified.

2. A device according to claim 1 wherein folds or pleats are incorporated in said expansible bladder to provide a minimal cross-section to flow in said drain line in normal standby position.

3. A device according to claim 1 wherein said reverse flow detector for a minimal cross-section has an elastic diaphragm located longitudinally on its surface parallel to flow for detection of reverse flow pressure, length of opening in said detector enclosed by said diaphragm proportional to degree of sensitivity desired for said detector.

4. A device according to claim 1 wherein said reverse flow detector contains an elastic diaphragm for detection of pressure, said elastic diaphragm in normal standby position open on one side to atmospheric pressure in said drain line and the other side, open by means of a connecting flexible tube, to the neutralizing atmospheric pressure outside of said drain line, said arrangement providing a simple means for verifying the integrity of said device by applying a predetermined partial vacuum, by means of said flexible tube, to said elastic diaphragm to simulate the condition of reverse flow in said drain line.

5. A device according to claim 4 wherein said flexible tube, extending outside said drain line from elastic diaphragm, provides a means for applying a predetermined pressure cycle to expand and deflate said elastic diaphragm, said arrangement facilitating the dislodgement of any obstructing material that may have been deposited on said diaphragm in normal standby position.

6. A device according to claim 1 wherein said bladder has one end joined to said reverse flow detector by means of an elastic tube and the other end to a similar elastic tube that extends outside said drain line upon installation, said elastic tubes constructed of a material having a predetermined thickness to allow for expansion and contraction of said elastic tubes in conjunction with said bladder when subjected to a predetermined pressure cycle, said pressure cycle facilitating the sloughing off of any deposits that may have accumulated on said elastic tubes and said bladder in normal standby position.

7. A device according to claim 1 wherein the intake of the pressure source is utilized as a vacuum source when required, to facilitate contraction of said device to the normal standby position when the backup condition is rectified.

8. A device for automatically preventing reverse flow in a gravity discharge line consisting of an expansible bladder in conjunction with a reverse flow detector, means for inserting said device to a remote section of said discharge line, a pressure source for expanding said bladder to a predetermined pressure to block reverse flow upon a signal from said reverse flow detector, and electrical and mechanical means for remote operation of said device, said electrical and mechanical means containing elements for return of said device to normal standby position when the condition causing reverse flow is eliminated.

9. A device for automatically preventing reverse flow in a discharge line consisting of an expansible bladder in conjunction with a reverse flow detector, means for inserting said device to a remote section of said discharge line, a pressure source for expanding said bladder to a predetermined pressure to block reverse flow upon signal from said reverse flow detector, and electrical and mechanical means for remote operation of said device, said electrical and mechanical means containing elements for return of said device to normal standby position when the condition causing reverse flow is eliminated.

* * * * *